United States Patent [19]

Shimizu et al.

[11] 4,420,734

[45] Dec. 13, 1983

[54] DEFLECTING YOKE FOR USE IN PICTURE TUBE OF PROJECTION COLOR TELEVISION RECEIVER SET

[75] Inventors: Toshiharu Shimizu; Nobutaka Okuyama; Yoshikazu Naito; Syuzo Matsumoto, all of Yokohama, Japan

[73] Assignee: Hitachi, Ltd., Tokyo, Japan

[21] Appl. No.: 356,906

[22] Filed: Mar. 10, 1982

[30] Foreign Application Priority Data

Mar. 11, 1981 [JP] Japan ..... 56-33891

[51] Int. Cl.[3] ..... H01F 5/00

[52] U.S. Cl. ..... 335/213; 335/210; 313/421

[58] Field of Search ..... 335/210, 213, 212; 313/421, 425, 426, 427, 428

[56] References Cited

U.S. PATENT DOCUMENTS 2,793,311 5/1957 Thomas ..... 335/213 X 3,735,193 5/1973 Ikeuchi ..... 335/213 X

*Primary Examiner*—George Harris

*Attorney, Agent, or Firm*—Antonelli, Terry & Wands

[57] ABSTRACT

A projection color television receiver set comprises three picture tubes juxtaposed to one another and producing red, green and blue light images which are projected through respective lenses onto a single screen to be reproduced as a single synthesized color picture. In order that rectangular rasters produced by the picture tubes disposed at both sides of the center picture tube are prevented from being deformed into trapezoidal rasters when projected on the screen, deflecting yokes used in the lateral picture tubes are provided with horizontal deflection winding in such arrangement that trapezoidal rasters are produced on faceplates of the laterally disposed picture tubes, respectively, which rasters are projected in a rectangular form on the single screen in alignment with the rectangular raster produced and projected from the center picture tube, whereby a color picture of an improved quality is reproduced on the screen, involving substantially no misconvergence. Auxiliary deflecting yokes and associated electric circuit of complicated configuration required heretofore to this end are spared.

4 Claims, 19 Drawing Figures

DEFLECTING YOKE FOR USE IN PICTURE TUBE OF PROJECTION COLOR TELEVISION RECEIVER SET

BACKGROUND OF THE INVENTION

The present invention relates generally to a deflecting yoke suited for use in a picture tube of a projection color television receiver set. In more particular, the invention concerns the deflecting yokes used in picture tubes adapted for projecting light images to a screen in the directions inclined relative to the screen in a projection color television receiver set which comprises three picture tubes, i.e. a red light emitting picture tube, a green light emitting picture tube and a blue light emitting picture tube, wherein light images in respective colors produced by these three picture tubes are projected to a single screen to thereby reproduce a synthesized color picture on the screen.

There has been known a projection color television receiver set which comprises a first picture tube provided with a red light emitting phosphor (hereinafter referred to also as the red picture tube), a second picture tube provided with a green light emitting phosphor (hereinafter referred to also as the green picture tube) and a third picture tube provided with a blue light emitting phosphor (hereinafter referred to also as the blue picture tube), wherein light images or pictures reproduced on face plates of these picture tubes, respectively, are projected onto a single screen through projection lenses disposed, respectively, in front of the associated face plates, to thereby reproduce or reconstruct a color picture on the screen. In the projection color television receiver set of this type, the three picture tubes are disposed in juxtaposition to one another. For example, the green picture tube for producing the green light image is disposed at the center of the juxtaposed array, while the red picture tube for producing the red light image is located on one side of the green picture tube with the blue picture tube being positioned on the other side. In the projection color television receiver set of such arrangement, the light images produced by the red picture tube and the green picture tube which are latterally disposed are projected onto the screen in the directions inclined relative to the plane of the screen, because the face plates of these picture tubes are positioned at an angle to the screen. For this reason, the images or pictures produced by the blue picture tube and the red picture tube are difficult to be converged and reproduced on the screen in the correct patterns or forms. On the other hand, the image produced by the green picture tube disposed at the center of the juxtaposed tube array can be reproduced on the screen in a relatively correct form without any appreciable deformation. More particularly, reference is to be made to FIG. 1 of the accompanying drawings. An electron beam emitted by an electron gun 1*c* is deflected by a deflecting yoke 1*b*, whereby a raster of a rectangular form is produced on a faceplace 1*a* of a picture tube 1 by the deflected electron beam. When the faceplate 1*a* of the picture tube 1 is disposed in parallel with the screen 4, the rectangular raster 5 produced on the faceplate 1*a* is projected onto a screen 4 through a lens system 2 in a raster 6 of a corresponding rectangular form with a given magnification, as is illustrated in FIG. 3. On the other hand, when the faceplate 1*a* of the picture tube 1 is disposed with an inclination to the screen 4 at an angle $\theta$ as shown in FIG. 2, the raster 5 produced on the faceplate 1*a* of the picture tube 1 is deformed to a raster 7 of a trapezoidal form when projected onto the screen 4, as can be seen in FIG. 3. In this connection, it will be noted that when the picture tube 1 is disposed on the righthand side relative to the center 0 of the screen 1 as viewed in FIG. 2, the magnified raster 7 projected on the screen 4 is so deformed as to have a long left side and a short right side, as is illustrated in FIG. 3. On the other hand, when the picture tube 1 is disposed on the left side relative to the center 0 of the screen 4, the raster 7 on the screen 4 has of course a short left side and a long right side. Such difference in the form of the rasters projected on the screen 4 will naturally give rise to the problem of misconvergence in the projection color television receiver set.

Further, when the surface of the screen 4 facing toward the projector 1 is curved spherically as indicated by a broken line 4*a* in FIG. 2, vertical lines 7*a* of the raster 7 on the screen 4 become arcuate, as is illustrated in FIG. 3. Such arcuate vertical lines 7*a* also bring about the problem of misconvergence.

In order that the raster making appearance on the screen be of the correct rectangular form in the projection system of the above mentioned arrangement, the raster on the face plate 1*a* of the picture 1 will have to be reproduced, for example, with a deformation reverse or complementary to that of the raster 7 produced on the screen 4 with the vertical raster lines produced on the faceplate 1*a* being also curved in the direction opposite to that of the raster lines 7*a*, so that deformation or distortion of the raster produced on the faceplate 1*a* of the picture tube 1 is cancelled out upon being projected onto the screen 4. In the hitherto known projection color television receiver set, generation of the raster of the complemental trapezoidal form having complementarily arcuated vertical lines on the faceplate of the picture tube 1 is accomplished, for example, by resorting to the use of an auxiliary deflecting yoke and an associated electrical circuit for supplying a current to the auxiliary deflecting yoke. However, such electrical circuit can usually be realized only in an extremely complicated configuration and nevertheless suffers from a serious drawback that the performance of the circuit is very susceptible to variations under influence of variations in the source voltage, for example, as the result of which the form of the raster reproduced on the faceplate 1*a* of the picture tube 1 and hence the form of the raster 7 projected on the screen 4 undergoes corresponding variations or distortions, involving again the problem of misconvergence. Further, linearity of the reproduced picture is adversely influenced. For these reasons, it has been difficult to produce the picture of a satisfactory quality on the screen 4.

SUMMARY OF THE INVENTION

An object of the present invention is therefore to provide a projection color television receiver set in which a desirably deformed raster can be produced on a faceplate of a picture tube without using electrical circuit for deforming the raster form, whereby a raster of a correct form can be produced on a screen without misconvergence and distortions of the raster.

Another object of the present invention is to provide a deflecting yoke for use in a projection color television receiver set, which yoke is provided with a deflecting coil capable of forming a desirably deformed raster on the faceplate of the picture tube.

The present invention starts from the fact that the electron beam emitted from an electron gun is deflected by magnetic fields produced by currents flowing through deflection windings of a deflecting yoke, whereby a raster is formed on a faceplate of the picture tube, and that the form of the raster can thus be varied by varying the currents flowing through the deflection windings to thereby vary the magnetic fields. Further, when configuration of the deflection windings is modified, the pattern of the deflecting magnetic fields is caused to be correspondingly varied to bring about variation or deformation in the form of the raster produced on the faceplate. According to an aspect of the present invention, configuration of the deflection windings of the deflecting yoke is modified so that the pattern of the magnetic fields produced by the currents flowing through the deflection windings is varied in such a manner in which the raster produced on the faceplate of the picture tube is of a trapezoidal form and has arcuated vertical lines, wherein the raster of the trapezoidal form is converted to a rectangular form upon being projected onto the screen.

Usually, the deflecting yoke comprises a cylindrical or trumpet-like core, a vertical deflection winding wound in a toroidal form around the core and a horizontal deflection winding of a saddle-like configuration accommodated within the core. Heretofore, the vertical deflection winding and the horizontal deflection winding are implemented to be symmetrical relative to a horizontal plane or a vertical plane which contains a center axis of the deflecting yoke. In contrast, in the case of the deflecting yoke according to the inventoin, the horizontal deflection winding or the vertical deflection winding is so implemented as to be symmetrical relative to the horizontal plane containing the center axis of the deflection yoke but to be asymmetrical relative to the vertical plane containing that center axis.

BRIEF DESCRIPTION OF THE DRAWINGS

FIG. 12(*b*) shows in pattern diagrams forms of rasters produced on faceplates of the individual picture tubes.

FIG. 16 schematically illustrates a pattern of raster produced on a faceplate of a picture tube in which the horizontal deflection winding of the deflecting yoke according to the invention is made use of.

DESCRIPTION OF THE PREFERRED EMBODIMENTS

Figure 1:
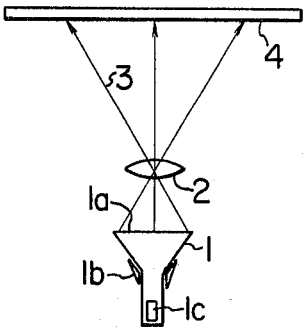
FIGS. 1 and 2 schematically illustrate a simplified and partially removed arrangement of a projection color television receiver set.
Figure 2:
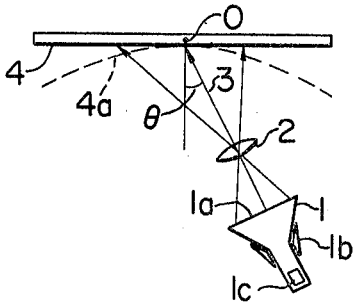
Figure 3:
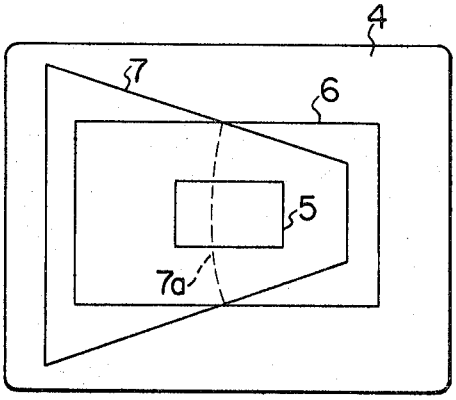
FIG. 3 illustrates patterns of rasters projected on a screen of the projection color television receiver set.
Figure 4:
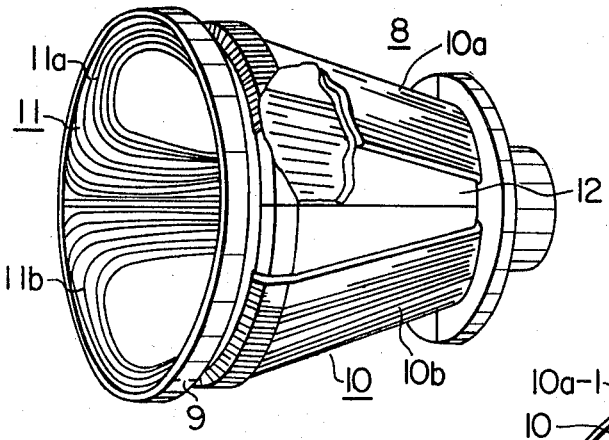
FIG. 4 shows in a perspective view a deflecting yoke according to an examplary embodiment of the invention.
Figure 5:
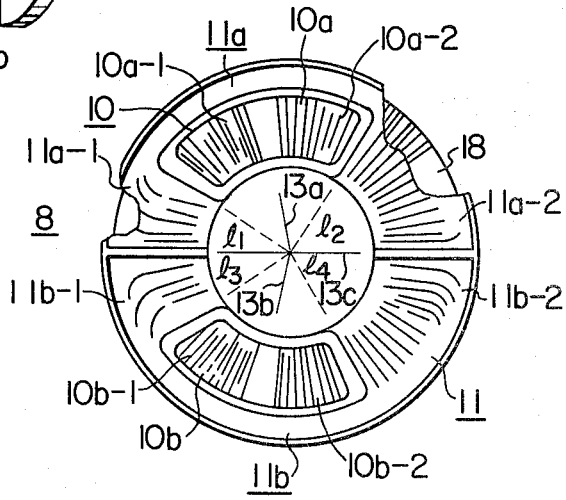
FIG. 5 is a front view of the same.

Referring to FIGS. 4 and 5 of the accompanying drawings, there are shown in a perspective view and a front view, respectively, a deflection yoke according to a first exemplary embodiment of the invention with a portion being broken away.

A main portion of the deflecting yoke 8 according to the first exemplary embodiment of the invention is constituted by a horizontal deflection winding 11 which in turn is composed of a pair of horizontal coils 11*a* and 11*b* realized in a saddle-like configuration and disposed in opposition to each other, and a vertical deflection winding 10 which is composed of a pair of vertical coils 10*a* and 10*b* wound in a toroidal form on a core 12. The coil 10*a* of the vertical deflection winding 10 in turn is constituted by coil blocks 10*a*-1 and 10*a*-2, while the coil 10*b* is constituted by coil blocks 10*b*-1 and 10*b*-2. The horizontal deflection winding 11 and the vertical deflection winding 10 are isolated from each other by means of a separator member 9. In the case of the illustrated deflecting yoke 8, the side conductors 11*a*-1 and 11*a*-2 of the coil 11*a* constituting one part of the horizontal deflection winding 11 are wound in different angular widths $l_1$ and $l_2$, respectively, while side conductors 11*b*-1 and 11*b*-2 of the coil 11*b* constituting the other part of the horizontal deflection winding 11 are also wound in different angular widths $l_3$ and $l_4$, respectively. In this connection, it is to be noted that the winding angular widths $l_1$ and $l_3$ are substantially equal to each other while the angular widths $l_2$ and $l_4$ are substantially equal to each other. On the other hand, the individual coil blocks 10*a*-1, 10*a*-2, 10*b*-1 and 10*b*-2 of the vertical deflection winding 10 are formed in a substantially identical configuration, wherein the coil blocks 10*a*-1 and 10*a*-2 are disposed symmetrically relative to an axis 13*a*, while the coil blocks 10*b*-1 and 10*b*-2 are disposed symmetrically relative to an axis 13*b*. Further, the coils 10*a* and 10*b* of the vertical deflection winding are disposed symmetrically relative to an axis 13*c*. The axes 13*a*, 13*b* and 13*c* intersect one another at certain angles. In other words, the axes 13*a* and 13*c* are not perpendicular to each other, while the axes 13*b* and 13*c* do not extend perpendicularly to each other.

Next, description will be made on function of the horizontal deflection winding in the deflection yoke according to the first exemplary embodiment of the invention.

Figure 6:
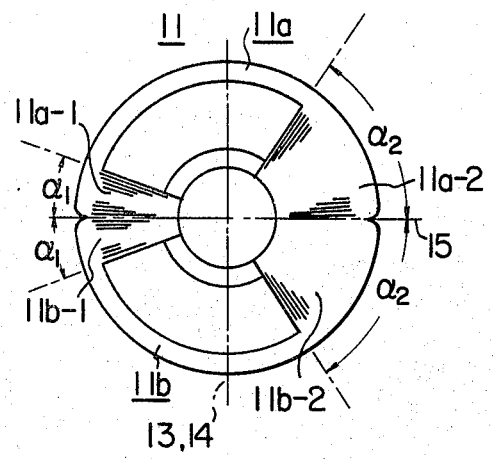
FIG. 6 shows in a front view an arrangement of horizontal deflection coils of the deflecting yoke according to a first exemplary embodiment of the invention.
Figure 7:
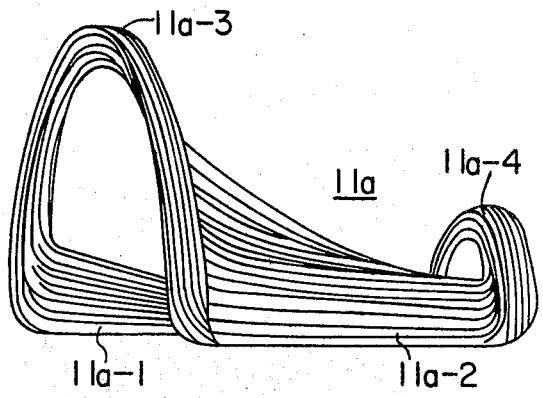
FIG. 7 shows in a perspective view a half of the horizontal deflection winding of the deflecting yoke according to the invention.
Figure 8:
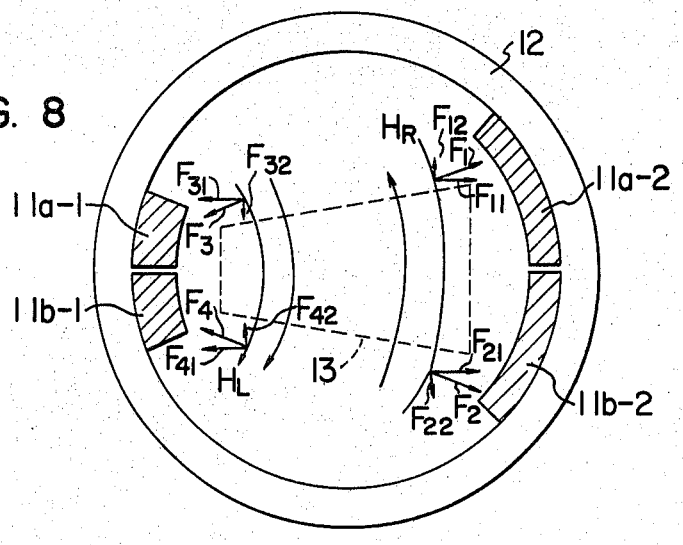
FIG. 8 schematically illustrates patterns of magnetic fields produced by currents flowing through the horizontal deflection coils according to the present invention.

As is illustrated in FIG. 6, the winding angular widths of the side conductors 11a-1 and 11b-1 of the horizontal deflection coils 11a and 11b constituting the horizontal deflection winding 11 of the deflecting yoke according to the invention are selected to correspond to an angle $\alpha_1$, while the winding angular widths of the side conductors 11a-2 and 11b-2 are selected equal to an angle $\alpha_2$, wherein the angle $\alpha_2$ is selected greater than $\alpha_1$. As will be seen in FIG. 7, end conductors 11a-3 and 11a-4 of the horizontal coil 11a have configurations substantially identical to those of the hitherto known horizontal deflection coil. Since the side conductors 11a-1 and 11a-2 of the saddle-like deflection coil have, respectively, a same number of turns, the winding density of the side conductors 11a-1 is higher than that of the side conductors 11a-2. The value of the angle $\alpha_1$ is so selcted that a magnetic field of a pincushion-like pattern is generated by currents flowing through the side conductors 11a-1 and 11b-1, while the magnitude of the angle $\alpha_2$ is so selected that a magnetic field of a barrel-like pattern is produced by currents flowing through the side conductors 11a-2 and 11b-2, as is illustrated in FIG. 8. When the barrel-like magnetic field $H_R$ is formed by the side conductors 11a-2 and 11b-2, an electron beam emitted from an electron gun (not shown) in subjected to a force $F_1$ or $F_2$ under the influence of the magnetic field $H_R$. Upon being subjected to the force $F_1$ or $F_2$, the electron beam is horizontally deflected under the action of a horizontal force component $F_{11}$ or $F_{21}$ while being vertically deflected under the action of a vertical force component $F_{12}$ or $F_{22}$. Since curvature of the barrel-like magnetic field $H_R$ is progressively increased at regions closer to the side conductors 11a-2 and 11b-2, vertical deflection of the electron beam becomes greater as it is deflected closer toward the side conductor 11a-2 or 11b-2. As the consequence, a raster 13 depicted on the faceplate of the picture tube is progressively enlarged in the vertical direction as the electron beam approaches closer to the side conductors 11a-2 or 11b-2. On the other hand, when the pincushion magnetic field $H_L$ is produced by the side conductors 11a-1 and 11b-1, the electron beam is subjected to a force $F_3$ or $F_4$, whereupon the electron beam is horizontally deflected under action of a horizontal force component $F_{31}$ or $F_{41}$ of the force $F_3$ or $F_4$ and at the same time tends to be prevented from being deflected in the vertical direction under action of a vertical foce component $F_{32}$ or $F_{42}$ of the force $F_3$ or $F_4$. Since the pincushion magnetic field $H_L$ is curved more significantly at locations closer to the side conductors 11a-1 and 11b-1, the vertical deflection of the electron veam encounters greater difficulty as the electron beam is deflected closer toward the side conductor 11a-1 or 11b-1. As the consequence, the raster 13 produced on the faceplate by the electron beam becomes progressively smaller as the electron beam approaches closer to the side conductor 11a-1 or 11b-1. The overall result is that the raster depicted on the faceplate takes a trapezoidal form, as indicated by bloken line 13 in FIG. 8.

Figure 9:
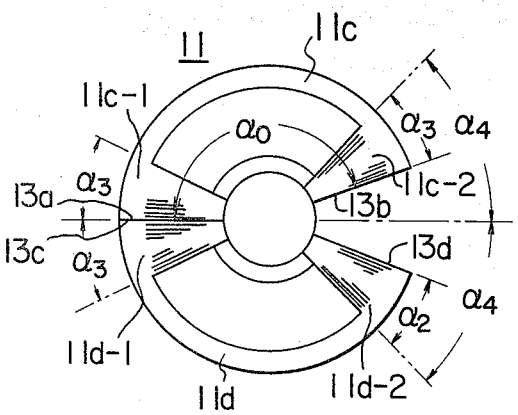
FIG. 9 shows in a front view another arrangement of horizontal deflection coils according to a second exemplary embodiment of the invention.
Figure 10:
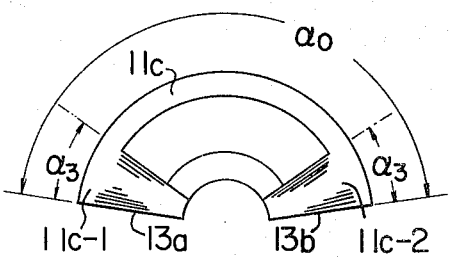
FIG. 10 shows in a front view a coil half of the horizontal deflection winding shown in FIG. 9.

Referring to FIG. 9, there is shown a horizontal deflection winding of the deflecting yoke according to a second exemplary embodiment of the invention. In the case of the horizontal deflection winding, the winding angular width of the side conductors 11c-1 and 11d-1, respectively, is selected to be equal to an angle $\alpha_3$, while the effective winding angular width of the side conductors 11c-2 and 11d-2, respectively, is selected to correspond to an angle $\alpha_4$, wherein the angle $\alpha_4$ is selected greater than the angle $\alpha_3$. The value of the angle $\alpha_3$ is so determined that a magnetic field of a pincushion-like form is produced by currents flowing through the side conductors 11c-1 and 11d-1, while the angle $\alpha_4$ is so determined that a magnetic field of a barrel-like pattern is generated by currents flowing through the side conductors 11c-2 and 11d-2. A characteristic structure of this horizontal deflection winding 11 resides in that the actual winding angular width of the side conductor 11c-2 is selected equal to that of the side conductor 11c-1, i.e. at the angle $\alpha_3$, as is illustrated in FIg. 10 for the coil 10c. More specifically, the winding angular width of the side conductors 11c-1 and 11c-2, respectively, is selected equal to the angle $\alpha_3$, while an angle $\alpha_o$ between an end 13a of the side conductors 11c-1 and an end 13b of the side conductors 11c-2 is selected smaller than 180°. Since the end 13a of the side conductors 11c-1 is disposed close to an end 13c of the side conductors 11d-1, the end 13b of the side conductors 11c-2 is disposed with a distance from an end 13d of the side conductors 11d-2, involving the effective winding angle $\alpha_4$. Of course, both the coils 11c and 11d are implemented in a same configuration, respectively. Also in this horizontal deflection winding 11, a magnetic field of a pincushion-like form is generated by current flowing through the side conductors 11c-1 and 11d-1, while a barrel-like magnetic field is produced by currents flowing through the side conductors 11c-2 and 11d-2. Thus, the raster produced on the faceplate of the picture tube is of a trapezoidal form for the same reasons as elucidated hereinbefore in conjunction with the first exemplary embodiment by referring to FIGS. 6 and 8.

Figure 11:
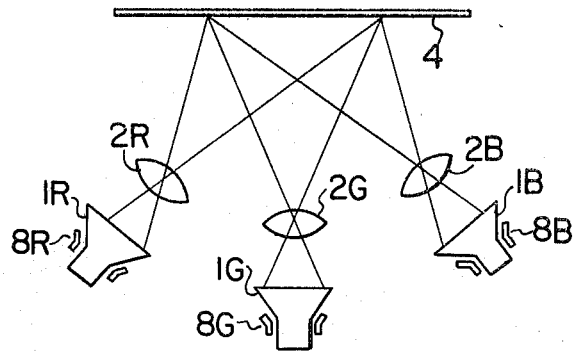
FIG. 11 schematically illustrates an arrangement of a projection color television receiver set.
Figure 12A:
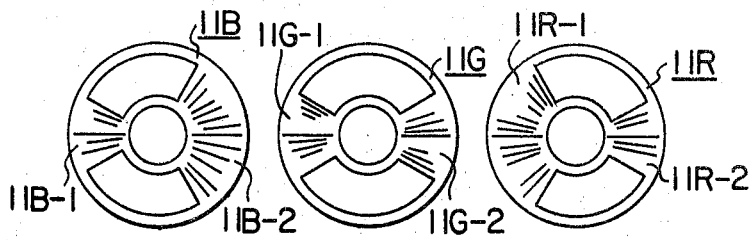
FIG. 12(*a*) shows in a front view horizontal deflection windings used in individual picture tubes of a projection color television receiver set.
Figure 12B:
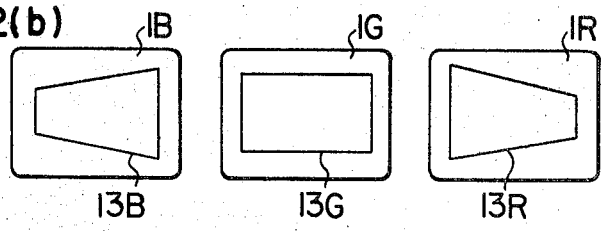

Referring to FIG. 11 which schematically illustrates an arrangement of a projection color television receiver set in which picture tubes incorporating deflection yokes according to the invention, a green picture tube 1G, i.e. the picture tube which produces light image in green is disposed at a center, while a red picture tube 1R for producing light image in red is disposed on the left side to the green picture tube 1G with a blue picture tube 1B for producing light image in blue being disposed on the right side, as viewed in the figure. Deflecting yokes 8G, 8R and 8B used in these picture tubes 1G, 1R and 1B, respectively, are shown in FIG. 12(*a*), while rasters 13G, 13R and 13B which are produced on faceplates of these picture tubes 1G, 1R and 1B, respectively, are illustrated in FIG. 12(*b*). As will be seen from FIG. 12(*a*), the horizontal deflection winding 11G of the green picture tube 1G located at the center of the juxtaposed tube array is constituted by side conductor groups 11G-1 and 11G-2 of an identical configuration as in the case of the hitherto known horizontal deflection winding. The raster 13G produced on the faceplate of the green picture tube 1G is of a rectangular form. In contrast, in the case of the horizontal deflection coil 11R used in the red picture tube 1R, the winding angular width of a side conductor group 11R-1 is different from that of a side conductor group 11R-2. In a similar manner, in the case of the horizontal deflection coil 11B used in the blue picture tube 1B, the winding angular width of a side conductor group 11B-1 differs from that of a side conductor group 11B-2. As the result, the rasters 13R and 13B produced on the faceplates of the picture tubes 1R and 1B, respectively, are of a trapezoidal form for the reasons elucidated hereinbefore. In this connection, it is noted that the horizontal deflection windings 11B and 11R of the red picture tube 1R and the blue picture tube 1B are disposed reverse to each other (i.e. in a mirror image relationship relative to the vertical center axis of the green picture tube 11G as viewed in FIG. 12), resulting naturally in that the trapezoidal rasters 13R and 13B produced on the faceplates of these picture tubes 1R and 1B are correspondingly reverse to each other, as is clearly seen from FIG. 12(*b*). The rasters 13B, 13G and 13R are projected onto a screen 4 through associated lenses 2B, 2G and 2R, respectively, whereby a color picture synthesized from the identical images in red, green and blue is produced on the screen 4.

Figure 13:
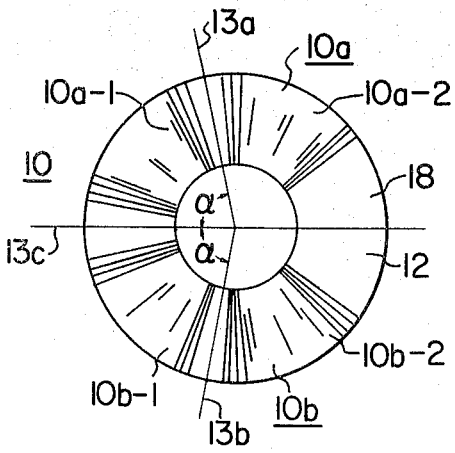
FIGS. 13 and 18 show in front views, respectively, vertical deflection windings which may be used in the deflection yoke according to the invention.
Figure 14:
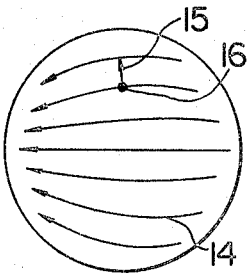
FIG. 14 schematically illustrates a pattern of magnetic field generated by a current flowing through the vertical deflection winding used in the deflecting yoke according to the invention.
Figure 15:
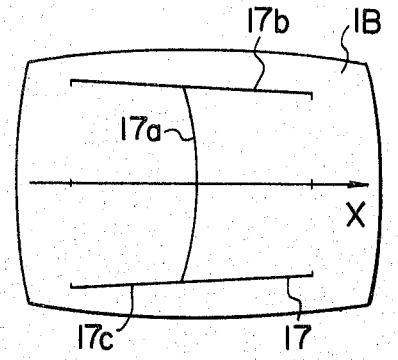
FIG. 15 schematically illustrates a pattern of a raster produced on a faceplate of a picture tube in which the vertical deflection winding shown in FIG. 14 is employed.
Figure 16:
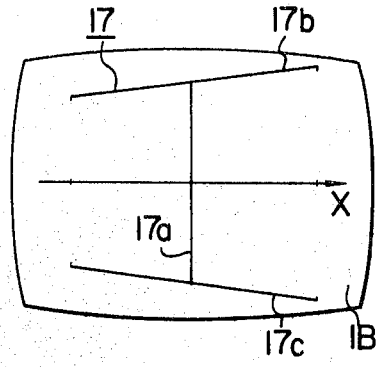
Figure 17:
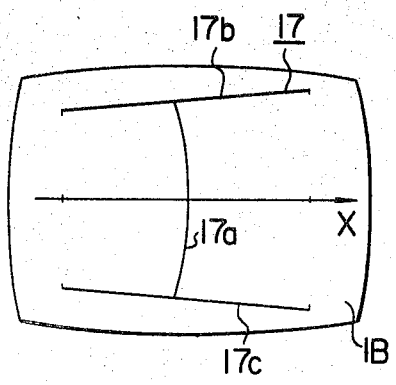
FIG. 17 schematically illustrates a pattern of raster produced on a faceplate of a picture tube in which the deflection yoke provided with both the vertical deflection winding and the horizontal deflection winding according to the invention is used.

Next, structure and function of a vertical deflection winding which can be used in the deflecting yoke according to the present invention will be described by referring to FIGS. 13 and 14. It is assumed that the vertical deflection winding shown in FIG. 13 is used in the deflecting yoke 8B for the blue picture tube 1B shown in FIG. 11. In the vertical deflection coil denoted generally by a reference numeral 10, the axis 13*a* of symmetry for the coil blocks 10*a*-1 and 10*a*-2 and the axis 13*b* of symmetry for the coil blocks 10*b*-1 and 10*b*-2 are not perpendicular to the axis 13*c* of symmetry for the vertical deflection coils 10*a* and 10*b* which constitutes the vertical deflection winding 10. As the consequence, the magnetic field produced by the vertical deflection winding 10 is so deformed that lines of magnetic force 14 are distributed at a higher density at a region adjacent to the coil blocks 10*a*-1 and 10*b*-1 than at a region adjacent to the coil blocks 10*a*-2 and 10*b*-2, as is illustrated in FIG. 14. Accordingly, in a space located adjacent to the vertical deflection coil 10*a*, the lines of magnetic force 14 extend downwardly to the left, while in a space located adjacent to the vertical coil 10*b*, the lines of magnetic force 14 extend upwardly to the left, as viewed in FIG. 14. Since an electron beam emitted by an electron gun is subjected to action of a force in the direction perpendicular to the line of magnetic force to thereby be deflected, as is well known, the electron beam denoted by 16 in FIG. 14 which is deflected in the vertical direction under influence of the lines of magnetic force 14 is simultaneously deflected to the left, i.e. toward the coil block 10*a*-1 or 10*b*-1. As the consequence, vertical lines 17*a* of a raster produced on the faceplate of the blue picture tube 1B are arcuated, bulbing in the direction of x-axis, as is illustrated in FIG. 15. On the other hand, upper horizontal raster lines 17*b* on the faceplate of the picture tube 1B extend downwardly to the right with lower horizontal raster lines 17*c* extending upwardly to the right, as viewed in FIG. 15, because the electron beam 16 undergoes a greater deflection by the side of the coil blocks 10*a*-1 and 10*b*-1 as compared with the deflection by the side of the coil blocks 10*a*-2 and 10*b*-2 due to the fact that the lines of magnetic force 14 are distributed more densely by the side of the coil blocks 10*a*-1 and 10*b*-1. In this manner, in the picture tube 1B provided with the vertical deflection winding 10 according to the present invention, the upper and lower horizontal raster lines 17*b* and 17*c* produced on the faceplate of the picture tube are caused to be inclined in the reverse directions, while the vertical raster lines 17*a* can be curved in the desired arcuate form, whereby the arcuate distortion of the projected picture or image otherwise produced on the screen 4 for the reason described hereinbefore can be complementarily and correctively compensated. Of course, the vertical deflection winding 10 is also effective to deflect the electron beam in such a manner in which the horizontal raster lines constitute a reverse trapezoidal raster distortion, which however can be satisfactorily corrected by the horizontal deflection winding 11. More particularly, the horizontal deflection winding 11 according to the invention is effective to produce such a raster 17 as shown in FIG. 16 on the faceplate of the picture tube 1B, as described hereinbefore, wherein the magnetic field produced by the currents flowing through the horizontal deflection winding 11 exerts greater influence to the horizontal lines 17*b* and 17*c* of the raster 17 than the magnetic field produced by the currents flowing through the vertical deflection winding 10, thus resulting in that a raster 17 illustrated in FIG. 17 is produced on the faceplate of the picture tube 1B.

Figure 18:
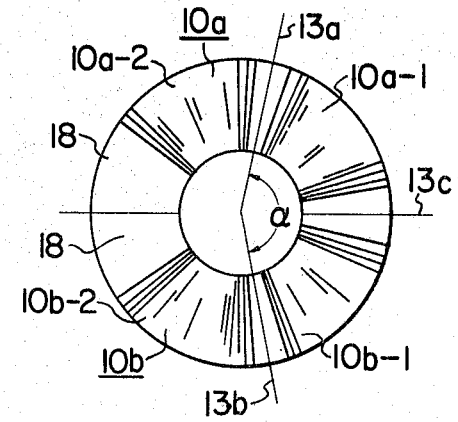

The above description has been restricted to the vertical deflection winding of the deflecting yoke 8B used in the blue picture tube 1B. However, the description holds true for the vertical deflection winding of the deflecting yoke used in the red picture tube 1R except for arrangement of the coil blocks in which the coil blocks 10*a*-1, 10*b*-1, 10*a*-2 and 10*b*-2 are disposed in such an arrangement as shown in FIG. 18 in the case of the vertical deflection winding for the yoke of the picture tube 1R. By the way, the vertical deflection winding of the deflecting yoke used in the green picture tube 1G located at the center position in the projection color television receiver set shown in FIG. 11 may be of the same structure and function as the one employed heretofore.

As will be appreciated from the foregoing description, the deflecting yokes according to the invention which are used in those picture tubes of the projection color television receiver set which project light image to a screen in the inclined directions allows rasters of reverse trapezoidal forms to be produced, respectively, on the faceplates of the associated projection tubes without resorting to the use of any auxiliary yokes, which rasters are projected and produced on the screen in a rectangular form. Thus, in the projection color television receiver set which comprises three picture tubes for producing red, green and blue light images, respectively, to be projected onto a single screen through respective lenses and in which the deflecting yokes according to the invention are employed in the manner described above, a synthesized color picture of an improved quality can be observed on the screen without necessity of use of the auxiliary yoke as well as the expensive and complicated circuits. Additionally, the deflecting yoke according to the invention used in the picture tubes in the manner described above allows the vertical raster lines on the faceplate of the associated projection tube to be curved arcuately to a desired degree in appropriate direction, as the result of which the raster formed on the screen contains the substantially straight vertical lines when the surface of the screen facing toward the picture tubes are curved in a concave profile in the horizontal direction. In this manner, all the rasters produced by the three picture tubes are projected on the screen in a single rectangular form, involving substantially no problem of misconvergence. The linearity of the picture reproduced on the screen is thus significantly improved while an excellent quality can be assured for the picture reproduced on the screen.

We claim:

1. A deflecting yoke for use in picture tubes of a projection color television receiver set adapted for reproducing color light images on a screen, said projection color television receiver set including first, second and third picture tubes for emitting red, green and blue light images, respectively, said first, second and third picture tubes being juxtaposed to one another with respect to the screen, light emitted from each of said first, second and third picture tubes being projected on the screen, and said deflection yoke being used in outer-side ones of said three picture tubes, wherein said deflection yoke comprises:

(a) a core of a trumpet-like configuration made of magnetic material;

(b) a vertical deflection winding constituted by a pair of vertical deflection coils wound in a toroidal form on said core, said pair of vertical deflection coils producing vertical deflection magnetic fields within said core when a current is rendered to flow through said vertical coils, said vertical deflection magnetic field being operable to deflect an electron beam passing through the inside of said core in a vertical direction; and (c) a horizontal deflection winding constituted by first and second horizontal coils each having a saddle-like configuration and disposed through and within said core, wherein each of said first and second horizontal coils has first and second side conductors, said first side conductor having a first winding angular width and said second side conductor having a second winding angular width larger than the first winding angular width, the first side conductor of said first horizontal coil and the first side conductor of said second horizontal coil being adjacent to each other and producing, in a pair, a first horizontal deflection magnetic field of a convex-like configuration in a space within said core when a horizontal deflection current is rendered to flow through said first and second horizontal coil, said first horizontal deflection magnetic field not only deflecting the electron beam passing through and within said core in a horizontal direction, but also deflecting the electron beam in a vertical direction so as to decrease the vertical width of a raster scanned on a face plate of said picture tube, the second side conductor of said first horizontal coil and the second side conductor of said second horizontal coil being adjacent to each other and producing, in a pair, a second horizontal deflection magnetic field of a convex-like configuration in a space within said core when a horizontal deflection current is rendered to flow through said first and second horizontal coil, said second horizontal deflection magnetic field not only deflecting the electron beam passing through and within said core to the horizontal direction, but also deflecting the electron beam to the vertical direction so as to increase the vertical width of a raster scanned on a face plate of said picture tube, whereby the electron beam deflected by said vertical deflection magnetic field produced by said vertical deflection winding and said first and second horizontal deflection magnetic fields produced by said horizontal deflection winding forms a raster scanned on the face plate of said picture tube in a trapezoid form.

2. A deflecting yoke for use in picture tubes of a projection color television receiver set adapted for reproducing color light images on a screen, said projection color television receiver set including first, second and third picture tubes for emitting red, green and blue light images, respectively, said first, second and third picture tubes being juxtaposed to one another with respect to the screen, light emitted from each of said first, second and third picture tubes being projected on the screen, and said deflection yoke being used in outer-side ones of said three picture tubes, wherein said deflection yoke comprises:

(a) a core of a trumpet-like configuration made of magnetic material;

(b) a vertical deflection winding constituted by a pair of first and second vertical coils wound in a toroidal form on said core, said pair of vertical coils producing vertical deflection magnetic fields within said core when a current is rendered to flow through said vertical coils, said vertical deflection magnetic field deflects an electron beam passing through the inside of said core in a vertical direction; and (c) a horizontal deflection winding constituted by first and second horizontal coils each having a saddle-like configuration and disposed through and within said core, wherein each of said first and second horizontal coils has first and second side conductors, said first side conductor having a first winding angular width and said second side conductor having a second winding angular width almost equal to the first winding angular width, said first and second side conductors being disposed in a manner that an angular distance from one end of said first side conductor to one end of said second side conductor is less than 180 degrees, said first side conductor of said first horizontal coil and said first side conductor of said second horizontal coil being adjacent to each other and forming a group of first side conductors in a pair, said second side conductor of said first horizontal coil and said second side conductor of said second horizontal coil being adjacent to each other and forming a group of second side conductors in a pair, said group of second side conductors being disposed in a manner that the substantive value of the winding angular width of said group of second side conductors is larger than the substantive value of the winding angular width of said group of first side conductors, said group of first side conductors producing a first horizontal deflection magnetic field of a convex-like configuration in a space within said core when a horizontal deflection current is rendered to flow through said first and second horizontal coil, said first horizontal deflection magnetic field not only deflecting the electron beam passing through and within said core in a horizontal direction, but also deflecting the electron beam in a vertical direction so as to decrease the vertical width of a raster scanned on a face plate of said picture tube, said group of second side conductors producing a second horizontal deflection magnetic field of a convex-like configuration in a space within said core when a horizontal deflection current is rendered to flow through said first and second horizontal coil, said second horizontal deflection magnetic field not only deflecting the electron beam passing through and within said core in a horizontal direction, but also deflecting the electron beam in a vertical direction so as to increase the vertical width of a raster scanned on a face plate of said picture tube, wherein the electron beam deflected by said vertical deflection magnetic field produced by said vertical deflection winding and said first and second horizontal deflection magnetic fields produced by said horizontal deflection winding forms a raster scanned on the face plate of said picture tube in a trapezoid form.

3. A deflecting yoke according to claim 1, wherein each of said first and second vertical coils has first and second coil blocks having substantially same configurations, said first and second vertical coils being disposed around said core symmetrically relative to a first face passing through a first axis, said first and second coil blocks being disposed around said core and being disposed relative to a second face passing through a second axis which crosses said first axis at an angle $\alpha$ less than 90 degrees, each of said first coil blocks being disposed in a space defined by said first and second faces, said first coil blocks of said first and second vertical coils producing, in a pair, an intensified first vertical deflection magnetic field of a barrel-like configuration when a vertical deflection current is rendered to flow through said first and second vertical deflection coils, said second coil blocks of said first and second vertical coils producing, in a pair, weakened second vertical deflection magnetic fields of a barrel-like configuration when a vertical deflection current is rendered to flow through said first and second vertical deflection coils, whereby the electron beam deflected by said first and second vertical deflection magnetic fields forms a vertical line of a raster scanned on the face plate of said picture tube in a bow-like configuration.

4. A deflecting yoke according to claim 2, wherein each of said first and second vertical coils has first and second coil blocks having substantially same configurations, said first and second vertical coils being disposed around said core symmetrically relative to a first face passing through a first axis, said first and second coil blocks being disposed around said core and being disposed relative to a second face passing through a second axis which crosses said first axis at an angle $\alpha$ less than 90 degrees, each of said first coil blocks being disposed in a space defined by said first and second faces, said first coil blocks of said first and second vertical coils producing, in a pair, an intensified first vertical deflection magnetic field of a barrel-like configuration when a vertical deflection current is rendered to flow through said first and second vertical deflection coils, said second coil blocks of said first and second vertical coils producing, in a pair, weakened second vertical deflection magnetic fields of a barrel-like configuration when a vertical deflection current is rendered to flow through said first and second vertical deflection coils, whereby the electron beam deflected by said first and second vertical deflection magnetic fields forms a vertical line of a raster scanned on the face plate of said picture tube in a bow-like configuration.

* * * * *